United States Patent [19]

Zimmerman

[11] 4,396,093

[45] Aug. 2, 1983

[54] LADDER OR BOOM EXTENSION SYSTEM

[76] Inventor: Mahlon N. Zimmerman, R.D. #2, Ephrata, Pa. 17522

[21] Appl. No.: 225,866

[22] Filed: Jan. 19, 1981

[51] Int. Cl.[3] ..... E06C 5/06

[52] U.S. Cl. ..... 182/208; 182/66

[58] Field of Search ..... 182/208, 207, 66, 67, 182/62.5, 2; 52/115, 116, 117, 118; 212/268, 264, 230, 269; 187/26; 414/663

[56] References Cited

U.S. PATENT DOCUMENTS

| | | | |
|---|---|---|---|
| 2,684,159 | 7/1954 | Oldenkamp | 52/115 |
| 2,732,992 | 1/1956 | Arps | 182/208 |
| 2,833,422 | 5/1958 | Ferwerda | 52/115 |
| 3,059,781 | 10/1962 | Bender | 52/115 |
| 3,836,011 | 9/1974 | Sakamoto | 212/269 |
| 4,094,381 | 6/1978 | Wilkerson | 182/208 |

OTHER PUBLICATIONS

Extension System, of Ladder Towers, Inc., 7/21/80.

*Primary Examiner*—Reinaldo P. Machado

*Assistant Examiner*—Alvin C. Chin-Shue

*Attorney, Agent, or Firm*—Karl L. Spivak

[57] ABSTRACT

A ladder or boom extension system includes a base section, at least one movable section in telescoping arrangement with the base section, and a piston rod fixedly connected longitudinally of the base section. A double acting hydraulic cylinder is movable relative to the piston rod in response to the application of hydraulic forces on either side of a fixed piston. A crosshead including cable carrying pulleys is affixed at each end of the hydraulic cylinder whereby the cylinder and the crossheads travel as a unit for extension and retraction while tensioning in response to hydraulic forces. Extension and retraction cables interconnect between the base section and the movable section and are trained about the crosshead pulleys to pull the movable section toward or away from the base section. The crosshead pulleys tension the cables upon longitudinal movement of the cylinder to either extend or retract the movable section or sections relative to the base section as the cylinder is longitudinally urged along the piston rod.

25 Claims, 4 Drawing Figures

LADDER OR BOOM EXTENSION SYSTEM

BACKGROUND OF THE INVENTION

The present invention relates generally to an aerial or boom extension system, and more particularly, is directed to a novel extension system that functions with its cylinder in tension.

Numerous types of telescoping booms and aerials have been designed and constructed by prior workers in the art to permit workmen to easily reach elevated heights for such purposes as building construction, fire fighting, tree prunning various electrical construction and maintenance procedures and the like. The present invention relates particularly to improvements over telescoping ladder or boom extension systems of the type which are equipped with a hydraulic cylinder or cylinders for extension or retraction purposes. So far as is known, in all of the presently available extension systems for booms or aerials which function upon use of hydraulic cylinders, the extension is accomplished by a hydraulic cylinder that operates in compression.

In the compression type cylinder system, the cylinder must be strongly designed so that the piston rod will not buckle under the compression forces required to extend a plurality of movable sections relative to a base section. This design concept requires a piston rod of enlarged diameter to provide the required strength, the size of which thereby increases both the weight and the cost of such apparatus. The presently available compression cylinder systems are therefore by their very nature quite massive in structure and relatively expensive in fabrication. Additionally, the weight of the cylinder components adversely affects the capacity of the entire boom or ladder extension system by reducing the power available for lifting and extending a given payload. The present invention seeks to provide an improved structure in the cylinder system which acts to lighten the system components and thereby reduce weight and costs and increase the available payload when utilizing the same power input.

SUMMARY OF THE INVENTION

The present invention relates generally to the field of ladder or boom extension systems, and more particularly, is directed to an improved extension system wherein the hydraulic cylinder is arranged in tension rather than in compression.

The present invention is particularly useful to function a multi-segment type of boom or ladder extension system and includes an improved double acting cylinder. The hydraulic cylinder is arranged on the base section in a manner to maintain the piston rod in stationary position and the cylinder in tension in all positions of extension or retraction of the movable section or sections relative to the base segment.

The piston rod is affixed longitudinally within the base segment or section and the cylinder is arranged for longitudinal movement relative to the fixed piston rod. A piston is medially affixed to the piston rod within the cylinder to cause longitudinal reciprocal movement of the cylinder relative to the piston rod upon the application of hydraulic fluid forces upon one side or the other of the piston. The cylinder terminates at each end in a crosshead means, each of which includes a pair of laterally positioned rollers or wheels. The base section rails are equipped with longitudinal tracks within which the crosshead wheels are movable. The respective interacting wheels and tracks facilitate longitudinal movement of the cylinder with its attached crossheads longitudinally either to the right or to the left along the base section for extension or retraction of the associated, telescoping, movable section or sections in response to the application of hydraulic fluid forces either to the left or to the right of the piston.

Each crosshead is similarly constructed and includes at least one pulley about which an extension or retraction cable is trained. Each end of the base section is provided with at least one cooperating pulley to rotatively receive a portion of an extension or retraction cable. The extension and retraction cables are affixed at one end to a remote end of the base section, are trained about a crosshead pulley and a cooperating pulley and then are affixed at their second ends to a remote end of the next movable segment. The extension and retraction cables function in opposite directions whereby upon movement of the cylinder towards the right of the base segment, the left cable or cables function in tension to pull the movable segment forwardly relative to the base segment, an operation which exerts tension forces on the left crosshead and on the attached cylinder. As the cylinder moves to the right, in the ladder or boom extension direction, the right cable or cables travel in a direction of elongation of the telescoping, movable section for balance and control purposes. When the movable segment is retracted by moving the cylinder to the left relative to the base section, the right cable or cables then function to pull the movable section telescopingly inwardly toward the base section to thereby reduce the overall length of the ladder or boom extension system. As the cylinder is urged in the direction of retraction, the right cables tension the right crosshead through the crosshead pulley and the base segment cooperating pulley and apply tension forces upon the cylinder, which forces act through the right crosshead.

It is noteworthy that as the cylinder travels along the base segment to the right during the ladder or boom extension operation, the cylinder moves in the direction of the system pivot, thereby tending to reduce the gravitational force vectors acting about the system pivot of the aerial or boom. This reduction of the extended effective weight of the system permits either the design of lighter structural members or the utilization of additional payload for the same structure and power requirements.

It is therefore an object of the present invention to provide an improved ladder or boom tension extension system of the type set forth.

It is another object of the present invention to provide a novel ladder or boom extension system comprising a movable extension and retraction cylinder wherein the cylinder is always functioned in tension.

It is another object of the present invention to provide a novel ladder or boom tension extension system comprising a base section, at least one movable section, a movable hydraulic cylinder connected for longitudinal movement in the base section and interconnecting cable means to extend or retract the movable section in response to movement of the cylinder.

It is another object of the present invention to provide a ladder or boom tension extension system comprising a base section, a movable section, a piston and piston rod fixedly arranged in the base section, a cylinder longitudinally movable relative to the piston rod and having a pulley supporting crosshead at each end, and cable means interconnected between the base section and the movable section and trained about the crosshead pulleys to extend or retract the movable section upon corresponding longitudinal movement of the cylinder relative to the piston rod.

It is another object of the present invention to provide a novel ladder or boom tension extension system comprising a base section, a movable section in telescoping relation to the base section, a piston rod fixedly connected longitudinally of the base section and a cylinder longitudinally movable relation to the piston rod, the cylinder carrying at each end an affixed crosshead, the crossheads each supporting cable pulleys and terminating laterally in transverse guides, the base section including longitudinally extending tracks within which the guides are movable in response to movement of the cylinder relative to the piston rod, and cables interconnected between the base section and the movable section and trained about the crosshead pulleys for extension or retraction of the movable section.

It is another object of the present invention to provide a novel tension aerial or boom extension system that is rugged in design, inexpensive in manufacturer and trouble free when in use.

Other objects and a fuller understanding of the invention will be had by referring to the following description and claims of a preferred embodiment, taken in conjunction with the accompanying drawings, wherein like reference characters refer to similar parts throughout the several views and in which:

DESCRIPTION OF THE PREFERRED EMBODIMENT OF THE INVENTION

Figure 2:
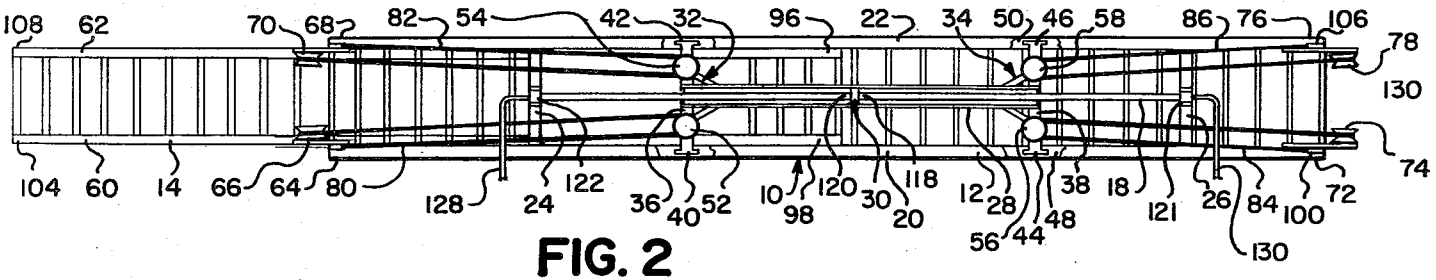
FIG. 2 is a bottom plan view of the ladder or boom extension system looking from line 2—2 on FIG. 1 in the direction of the arrows and partly broken away.

Although specific terms are used in the following description for the sake of clarity, these terms are intended to refer only to the particular structure of the invention selected for illustration in the drawings and are not intended to define or limit the scope of the invention.

Figure 1:
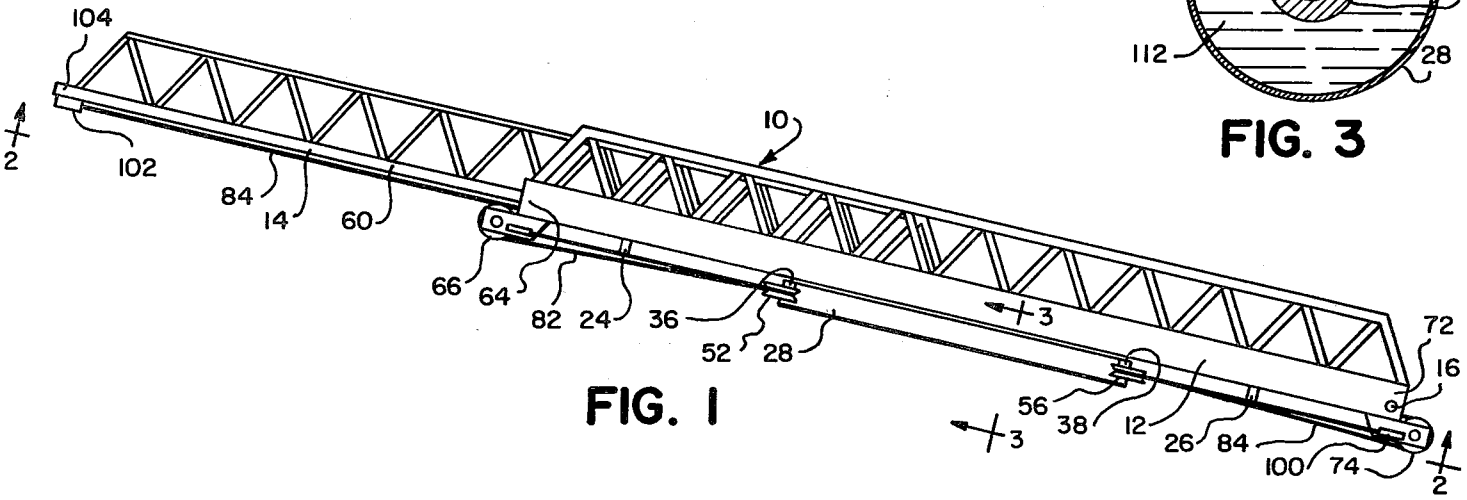
FIG. 1 is a side elevation view of the ladder or boom extension system comprising a base section and a movable section in accordance with the present invention. Conventional additional movable sections or the fly section have not been illustrated.

Referring now to the drawings, there is illustrated in FIGS. 1 and 2 a ladder or boom extension system 10 comprising generally a base section 12 and one or more extending sections 14, which sections are arranged in telescoping relation to the base section 12. The usual end or fly section of the aerial or boom system 10 is conventional in design and operation and accordingly need not be illustrated nor described in detail. In the manner well known to those skilled in the art, the base section 12 (and the telescopingly attached fly section and the movable section or sections 14) is elevated by pivoting about the pivot point 16 by a suitable mechanism (not shown), usually one or more hydraulic cylinders, which are interconnected between a portion of the ladder support and a portion of the base section or segment 12. Usually, a turntable (not illustrated) or other similar mechanism is also provided to rotate the ladder about its base, also in manner well known to those skilled in the art.

As used herein, the terms "ladder", "boom" and "aerial" are employed interchangeably as it is the extension system itself which forms the subject matter of the present invention and not the type of telescoping elements which are functioned by the extension system.

Figure 4:
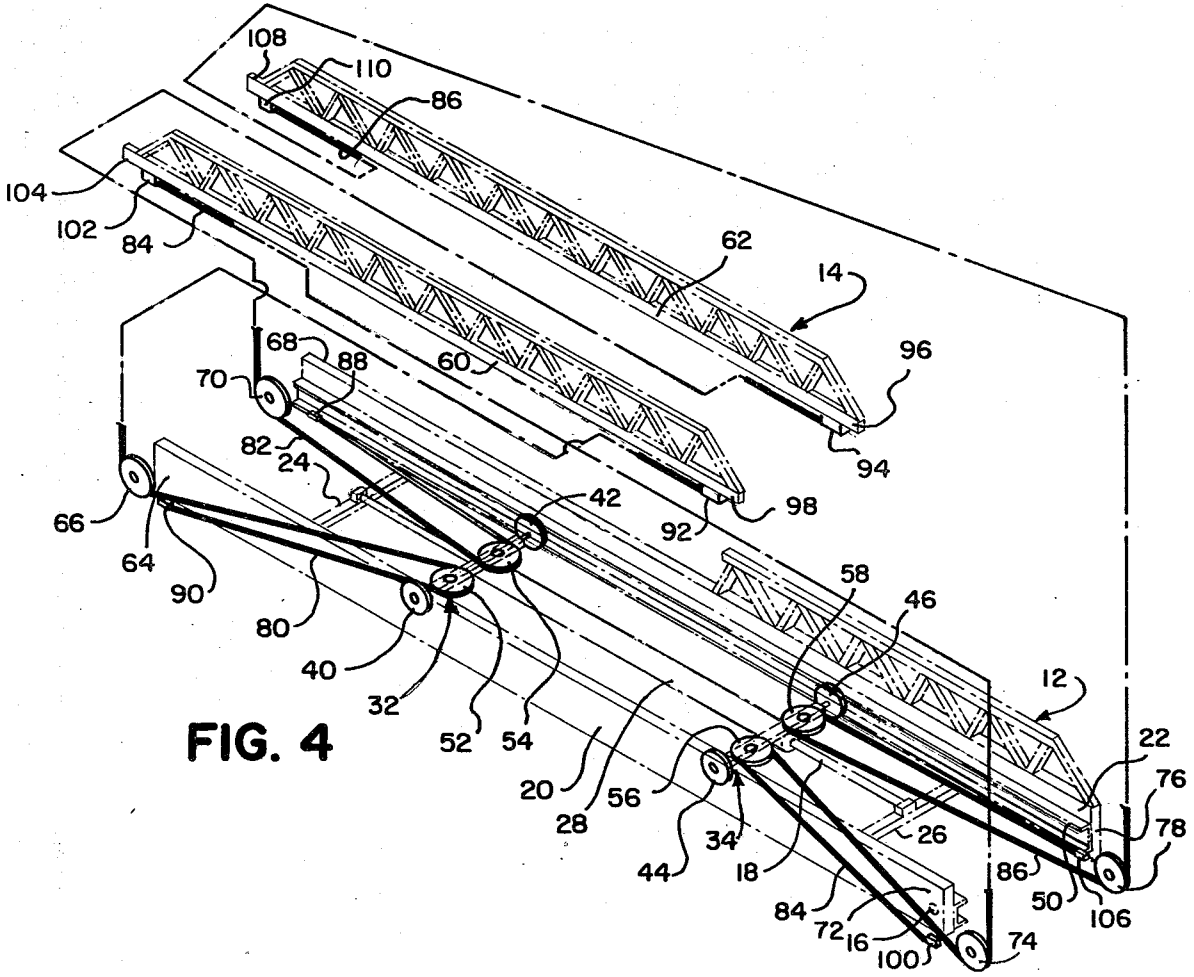
FIG. 4 is an exploded perspective view of the ladder or boom extension system showing the extension and retraction functioning apparatus in full lines and the base section and movable section in phantom lines.

As best seen in FIGS. 2 and 4, an elongate piston rod 18 is fixedly secured between the left and right rails 20, 22 of the base section 12 by employing transverse front and rear struts 24, 26 and suitable connectors as necessary to secure the piston rod in longitudinal relation to the base section 12. A piston 30, of known design, is affixed medially to the piston rod 18 to reciprocate the cylinder 28 in response to the application of hydraulic fluid forces as hereinafter more fully set forth. It will be appreciated that in certain constructions, depending upon the size and weight of the structure, it may be desirable to utilize a pair of similar cylinders 28 and piston rods 18, operating in unison, to develop the necessary forces for ladder extension and retraction.

Still referring to FIGS. 1 and 2, the hydraulic cylinder 28 is longitudinally movable in the base section relative to the piston rod 18 and operatively extends both to the left and to the right of the piston 30 for activation by the hydraulic fluid forces for ladder extension and retraction. The cylinder 28 forwardly and rearwardly carries the respective front and rear crossheads 32, 34, which crossheads are similarly constructed and include guide means to facilitate cylinder movement and pulley means for cable extension and retraction. Each crosshead 32, 34 is similarly constructed and respectively includes a transverse axle 36, 38 securely affixed to a forward or rearward terminus of the cylinder 28. Each axle 36, 38 transversely carries a pair of spaced wheels or guides 40, 42 and 44, 46 to carry the cylinder 28 on the base section 12 in a manner to facilitate longitudinal movement of the cylinder 28 relative to the base section 12. Left and right tracks 48, 50 respectively inwardly affix to the left and right base section rails 20, 22 to provide longitudinal runways for the plurality of wheels or guides 40, 42, 44, 46. See FIG. 4. Each crosshead additionally carries one or more pulleys 52, 54, 56, 58 of conventional configuration, which pulleys are mounted for rotation about their respective pins in the usual manner. When the cylinder 28 is activated for movable section extension or retraction purposes in the manner hereinafter more fully set forth, the extension or retraction cables run over the pulleys 52, 54, 56, 58 to directly apply extension or retraction forces to the movable section 14.

The movable section 14 is fabricated of suitable structural members of known design and includes a left structural rail 60 and a right rail 62 transversely spaced therefrom. The left and right movable section rails 60, 62 are maintained in telescoping engagement with the respective left and right rails 20, 22 of the base section 12 in manner well known to those skilled in the art whereby the movable section 14 can readily telescope or longitudinally move relative to the base section 12 in response to forces generated upon activation of the cylinder 28.

Referring now to FIGS. 1, 2 and 4, it will be observed that the forward terminus 64 of the left base section rail 20 is equipped with a pulley 66, which pulley cooperates with the left front crosshead pulley 52 and the cable 80 in the manner hereinafter more fully described. Similarly, the forward terminus 68 of the right base segment rail 22 is equipped with a rotatively arranged right pulley 70, which pulley 70 cooperates with the right crosshead pulley 54 and cable 82 in the manner hereinafter more fully described. The rear terminus 72 of the left rail 20 of the base section 12 rotatively carries a left pulley 74 through a suitable bracket to function with the left rear crosshead pulley 56 and the extension cable 84 as hereinafter more fully set forth. A right rear pulley 78 is rearwardly carried by a suitable bracket affixed to the rear terminus 76 of the right rail 22 of the base segment section 12 for cooperative interaction with the right rear crosshead pulley 58 and cable 86 as hereinafter more fully described.

The forward pair of extension and retraction cables 80, 82 forwardly interconnect the base section 12 and the movable section 14 and are respectively roped about the left and right pairs of pulleys 52, 66 and 54, 70 for two to one extension and retraction. A similar pair of extension and retraction cables 84, 86 also interconnect portions of the movable section 14 with the base section 12 and are roped about the left and right pulley pairs 56, 74 and 58, 78 for two to one movement of the movable section 14 relative to the cylinder 28. As best seen in FIGS. 2 and 4, the left front cable 80 is affixed at one end to the forward terminus 64 of the left base section rail 20 and at its other end to the rear terminus 98 of the movable section left rail 60. As illustrated, the left forward cable 80 is trained about the crosshead pulley 52 and the forward left pulley 66 to facilitate the extension and retraction of the movable section 14. Similarly, the right forward cable 82 is fixedly connected at one end 88 to the forward terminus 68 of the right base section rail 22 and at its second end 94 to the rear terminus 96 of the movable section right rail 62. The right front cable 82 is trained about the right crosshead pulley 54 and the right forward pulley 70 to aid in the extension and retraction of the movable section 14 relative to the base section 12.

In a similar roping arrangement, the left rear cable 84 fixedly connects at one end 100 to the rear terminus 72 of the left base segment rail 20. The cable 84 is trained about the left rear crosshead pulley 56 and the left rear pulley 74 and terminates at its second end 102 in a fixed connection to the forward terminus 104 of the movable section left rail 60. The right rear cable 86 has one end 106 fixedly connected to the rear terminus 76 of the right base section rail 22 and is rotatively trained about the right rear crosshead pulley 58 and the right rear pulley 78 to operatively interconnect the cable 86 between the base section 12 and the movable section 14. As best seen in FIG. 4, the second end 110 of the right rear cable 86 is fixedly connected to the right front terminus 108 of the right movable section rail 62 for telescoping movement of the movable section 14 in the manner hereinafter more fully set forth.

Figure 3:
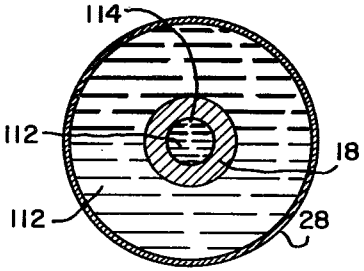
FIG. 3 is an enlarged, cross sectional view taken along line 3—3 on FIG. 1, looking in the direction of the arrows.

In order to operate the extension ladder or boom extension system of the present invention in retraction, a conventional hydraulic circuit (not shown) can be activated in well known manner to pump hydraulic fluid 112 (FIG. 3) through the left hydraulic input line 128 and through the left holding valve 122 to pressurize the left side of the hollow interior 114 of the piston rod 18. The hydraulic fluid 112 travels through the left port 120 to pressurize the interior of the cylinder 28 to the left of the piston 30, thereby causing the cylinder 28 to move along the tracks 48, 50 to the left as viewed in FIG. 2. Movement of the cylinder 28 with the attached right crosshead pulleys 56, 58 to the left will tension the right extension cables 84, 86, which cables then act through their respective intermediate pulleys 74, 78 to apply tension forces at the respective cable ends 102, 110. As best seen in FIG. 4, the cable ends 102, 110 are affixed to the forward termini 104, 108 of the left and right rails of the movable section 14 to thereby cause rearward or inward telescoping movement of the movable section 14 relative to the base section 12.

When it is desired to extend the movable section 14 relative to the base section 12, the hydraulic circuit (not shown) is functioned conventionally to introduce hydraulic fluid 112 under pressure through the right hydraulic input line 130 and through the right holding valve 121 to pressurize the cylinder 28 on the right side of the piston 30. This causes the cylinder 28 to move along the tracks 48, 50 toward the right to also move the left crosshead pulleys 52, 54 toward the right. This in turn tensions the left or forward cables 80, 82, which cables act about the intermediate pulleys 66, 70 to tension the rearward cable ends 92, 94. As above set forth, the cable ends 92, 94 are secured in the respective rear termini 98, 96 of the movable section rails 60, 62 to thereby cause forward or advance telescoping movement of the movable section 14 relative to the base section 12.

What is claimed is:

1. In an extension system for a ladder or boom of the type including a base section and at least one section movable relative to the base section, the combination of a piston having two sides and a piston rod, the piston being medially affixed to the piston rod and the piston rod being fixedly secured in the base section, the piston rod having a hollow interior on each side of the piston;

a hydraulic circuit alternately introducing hydraulic fluid under pressure through the hollow interior of the piston rod to alternately pressurize the sides of the piston;

a hydraulic cylinder overfitting the piston and a portion of the piston rod, the cylinder being longitudinally movable relative to the piston rod alternately in opposite directions in response to the application of hydraulic pressure upon a side of the piston;

a first crosshead means affixed to the cylinder and adapted to be moved by the cylinder, the first crosshead means rotatively carrying at least a first pulley; and a first cable means trained about the first pulley, the first cable means having first and second ends, the ends being respectively connected to a portion of the base section and to a postion of the movable section, whereby the cable causes movement of the movable section relative to the base section in response to movement of the cylinder.

2. The extension system of claim 1 and means to cause the movable section to move twice the distance that the cylinder moves when the cylinder is moved by the hydraulic circuit, and wherein the means to cause comprises a first pulley connected to the base section, said first pulley being connected for rotation about the base section, the first cable means being trained for rotation about the said first pulley.

3. The extension system of claim 1 wherein the first crosshead means includes at least a first guide to aid the longitudinal movement of the cylinder.

4. The extension system of claim 3 wherein the base section comprises a longitudinal track and wherein the first guide is movable along the track.

5. The extension system of claim 4 wherein the first guide of the first crosshead means is laterally spaced from the cylinder.

6. The extension system of claim 5 and a second guide spaced from the first guide and being laterally spaced from the cylinder.

7. An extension system for a ladder or boom of the type including a base section and at least one section movable relative to the base section in response to forces directed by a hydraulic circuit comprising a piston and piston rod fixedly secured in the base section;

a hydraulic cylinder longitudinally movable relative to the piston rod in response to hydraulic forces in the hydraulic circuit, the cylinder having a first end and a second end;

a first crosshead means affixed to the cylinder nearer to the first end and being adapted to be moved by the cylinder, the first crosshead rotatively carrying at least a first pulley;

a first cable means trained about the first pulley, the first cable means having first and second ends, the first and second ends being respectively connected to a portion of the base section and to a portion of the movable section; and a second crosshead means affixed to the cylinder nearer to the second end and being adapted to be moved by the cylinder; whereby the cable causes movement of the movable section relative to the base section in response to movement of the cylinder.

8. The extension system of claim 7 and a second pulley rotatively carried by the second crosshead means, the second pulley being moved longitudinally relative to the base section when the cylinder is moved.

9. The extension system of claim 8 and a second cable means trained about the second pulley, the second cable means having first and second ends, the said ends being respectively connected to a portion of the base section and to a portion of the movable section.

10. The extension system of claim 9 wherein the first end of the second cable means is connected to the front of the base section.

11. The extension system of claim 10 and wherein the second end of the second cable means is connected to the rear of the movable section.

12. The extension system of claim 11 and a first pulley connected for rotation about the base section, the first cable means being trained about the first pulley.

13. The extension system of claim 12 and a second pulley connected for rotation about the base section, the second cable means being trained about the second pulley.

14. The extension system of claim 12 wherein the first pulley connected to the base section is spaced from the second pulley connected to the base section by the length of the base section.

15. The extension system of claim 9 wherein the first end of the first cable means is connected to the rear of the base section.

16. The extension system of claim 15 or claim 11 and wherein the second end of the first cable means is connected to the front of the movable section.

17. An extension system for an aerial or boom having a base section and at least one movable section in telescoping relation thereto comprising a piston rod including a medially positioned piston secured in the base section;

a double acting cylinder longitudinally movable relative to the piston rod in response to fluid forces upon the piston;

a front crosshead and a rear crosshead secured to the cylinder and adapted to be moved as the cylinder is moved, each crosshead comprising at least one pulley and at least one guide;

a front cable trained about the front crosshead pulley and having its ends respectively secured to the base section and to the movable section; and a rear cable trained about the rear crosshead pulley and having its ends respectively secured to the base section and to the movable section;

whereby longitudinal movement of the cylinder causes either the front cable or the rear cable to pull the movable section to extend or retract the movable section relative to the base section.

18. The extension system of claim 17 and a front base section pulley forwardly secured to the base section, the front cable being trained about the front base section pulley and being adapted to cause movement of the movable section that is double the movement of the cylinder.

19. The extension system of claim 17 or claim 18 and a rear base section pulley rearwardly secured to the base section, the rear cable being trained about the rear base section pulley and being adapted to cause movement of the movable section that is double the movement of the cylinder.

20. The extension system of claim 17 and a track secured in the base section, the front and rear crosshead guides being positioned in the track to provide longitudinal movement of the cylinder relative to the base section.

21. The extension system of claim 17 wherein the piston rod is hollow and fluid flows through the piston rod.

22. The extension system of claim 21 wherein the piston rod is provided with a holding valve to control the flow of fluid.

23. The extension system of claim 22 wherein the piston rod is provided with an outlet port whereby fluid flows between the hollow interior of the piston rod and the interior of the cylinder.

24. The extension system of claim 17 wherein the front cable has one end secured to the front of the base section and its other end secured to the rear of the movable section.

25. The extension system of claim 17 or claim 27 wherein the rear cable has one end secured to the rear of the base section and its other end secured to the front of the movable section.

* * * * *